219-121 SR
1/13/87 OR 4,636,607

United States Patent [19]
Hayd et al.

[11] Patent Number: 4,636,607
[45] Date of Patent: Jan. 13, 1987

[54] METHOD OF ENHANCING AN ICE-BREAKING OPERATION

[75] Inventors: Axel Hayd, Munich; Peter Meinke, Starnberg; Martin Maurer, Munich; Joachim Schwarz, Grosshansdorf, all of Fed. Rep. of Germany

[73] Assignee: M.A.N. Maschinenfabrik Augsburg-Nurnberg Aktiengesellschaft, Fed. Rep. of Germany

[21] Appl. No.: 733,620

[22] Filed: May 13, 1985

[30] Foreign Application Priority Data

May 18, 1984 [DE] Fed. Rep. of Germany ..... 3418535
Sep. 15, 1984 [DE] Fed. Rep. of Germany ..... 3433961

[51] Int. Cl.[4] ..... B23K 27/00
[52] U.S. Cl. ..... 219/121 LM; 219/121 LN; 30/140; 114/40; 114/42

[58] Field of Search ..... 219/121 L, 121 LE, 121 LF, 219/121 LG, 121 LJ, 121 LW, 121 LN, 121 LM, 10.55 M, 10.55 R, 121 LU; 30/140, 164.5; 114/40, 42; 244/134 C, 134 D; 62/73

[56] References Cited

U.S. PATENT DOCUMENTS

| | | | |
|---|---|---|---|
| 1,477,631 | 12/1923 | Deenihan | 30/140 |
| 2,027,993 | 1/1936 | Methven | 30/140 |
| 3,539,221 | 11/1970 | Gladston et al. | 219/121 LM |
| 4,060,212 | 11/1977 | Magenheim | 244/134 D |
| 4,365,131 | 12/1982 | Hansman, Jr. | 219/10.55 M |
| 4,379,217 | 4/1983 | Youmans | 219/121 L |

*Primary Examiner*—Philip H. Leung
*Attorney, Agent, or Firm*—Scully, Scott, Murphy & Presser

[57] ABSTRACT

In order to perform an ice-breaking operation more readily or with a defined geometry, an ice breaking aid is employed by virtue of which the ice is irradiated with high-frequency oscillations such as phonons or photons prior to the ice-breaking operation proper.

5 Claims, 2 Drawing Figures

METHOD OF ENHANCING AN ICE-BREAKING OPERATION

BACKGROUND OF THE INVENTION

Figure 1:
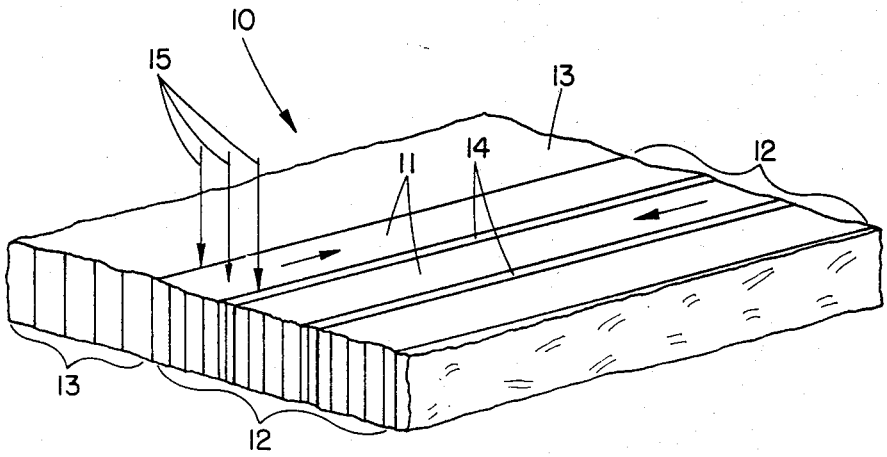

The invention relates to a method of enhancing ice-breaking operations.

Although ice-breakers are employed to keep frozen regions of the sea open for navigation, there have been hardly any improvements in the design of such vessels for decades. Conventional ice-breakers suffer from the disadvantage of a high power consumption, a low working speed, the possibility of damage by the ice and relatively poor sailing properties in the open sea.

A substantial advance was made with the introduction of a method based on the principle of shear fracture. However this recently developed form of ice-breaking only operates optimally on a restricted ice thickness range and in limited speed ranges so that if the speed of operation and the range of application are to be further increased, this system of ice-breaking may only be used with supplementary ice-breaking aids. Mechanical ice-breaking aids have also been proposed, with which the ice is scored and pre-cracked.

SUMMARY OF THE PRESENT INVENTION

One object of the invention is to devise a method of the sort initially specified which may be undertaken as simply as possible while at the same time ensuring an effective preparation of the ice so that it may be more readily and rapidly broken.

To effect this and other objects the ice is irradiated with high-frequency waves prior to the ice breaking operation as such.

The irradiation causes the characteristic properties of the ice such as the modulus of elasticity, the thrust modulus and the fracture toughness of the ice to be so modified that predefined breakage patterns result, this then reducing the energy needed for fracturing the ice in the ensuing breaking operation.

The method of the invention furthermore makes it possible for ice fragments to be produced with a predetermined geometry by irradiating along the outlines of the desired fragments so that a sort of fracture line or surface is predetermined.

The energy used for irradiation is preferably in the form of phonons or photons as produced by a maser or a laser. Such energy for irradiation constitutes an aid to ice-breaking that is substantially simpler to apply than conventional mechanically performed ice-breaking aids.

It is an advantage if the surface of the ice to be broken is irradiated in a pattern of parallel lines and along predetermined tracks so that the crystal structure and therefore the mechanical properties of the ice are modified all over the surface. The strength and the modulus of elasticity of the ice are this reason further reduced in this zone so that the ice-breaker then moving through the zone will have to apply substantially less energy. Therefore the ice-breaker may be also driven through the ice.

There are applications, as for example for research work, in which a modification of the ice structure that is as homogeneous as possible is desired. For such a purpose the invention proposes the utilisation of a broad beam in order to modify the ice in its mechanical properties over a wide area at a time and therefore achieve an even modification in the structure.

The ice-breaking aid in accordance with the invention is not only applicable to maritime ice but furthermore to any ice layer (as for example in the form of a glacier or a frozen mountain lake) that is to be broken.

DETAILED ACCOUNT OF THE INVENTION WITH REFERENCE TO THE FIGURES

Figure 2:
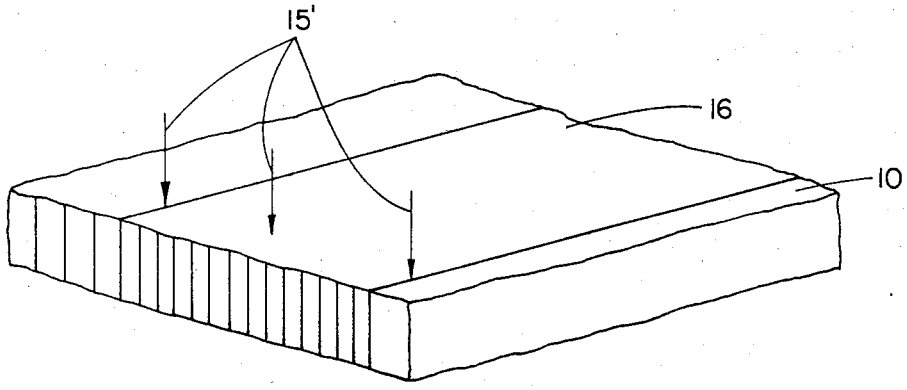

FIGS. 1 and 2 are two perspective views of portions of ice sheets that are to be broken by the method of the invention.

The beam producing device, as for example one in the form of a high-frequency modulated laser, is moved over the ice 10 in FIG. 1 along parallel tracks 11 backwards and forwards. By the use of high-frequency radiation in a beam 15, whose frequency is so selected that it excites the inter- and intramolcular frequencies of oscillation in the ice, the structure of the ice is modified along the zones of irradiation 11 and therefore the strength is reduced. Accordingly the ice may be more readily broken in the irradiated zone 12 than in the untreated parts 13.

The double irradiation occurring in the overlapped zones 14 at the edges of the two tracks of irradiation may cause a further change in structure.

If it is desired to avoid or reduce inhomogeneity in the new structure, a broad energy beam 15' will be employed that acts on the ice 16 over a wide area in a single passage.

A further possible application is the irradiation of single, preset straight or curved tracks that function as surfaces of weakness controlling the size and geometry of the ice fragments to be produced in the ensuing breaking operation.

We claim:

1. A method of breaking large areas of ice, particularly in the ocean, comprising:

(a) selecting a radiation beam frequency to excite the intermolecular and intramolecular frequency of oscillation in the ice to be broken;

(b) irradiating at least a portion of the ice to be broken with a radiation beam having said selected frequency, (c) preparing the ice for breaking by irradiating said ice in a predefined breakage pattern forming at least one zone of irradiation, the mechanical properties of the ice being modified on the surface of the ice within said at least one irradiation zone thereby reducing the energy needed to break the ice; and (d) breaking the prepared portion of the ice.

2. The method as claimed in claim 1 wherein the ice is irradiated with phonons.

3. The method as claimed in claim 1 wherein the ice is irradiated with photons.

4. The method as claimed in claim 1 wherein the surface of the ice to be broken is irradiated along tracks.

5. The method as claimed in claim 4 wherein the ice is irradiated over a large area along wide bands.

* * * * *